US010214395B2

(12) United States Patent
Pan et al.

(10) Patent No.: US 10,214,395 B2
(45) Date of Patent: Feb. 26, 2019

(54) GANTRY ASSEMBLY AND A SYSTEM FOR REPLACING SINGLE OR DOUBLE RAILWAY BRIDGES

(71) Applicants: Da Pan, Beijing (CN); Yabin Liu, Beijing (CN); Wei Chen, Beijing (CN); PoJing Liu, Beijing (CN)

(72) Inventors: Da Pan, Beijing (CN); Yabin Liu, Beijing (CN); Wei Chen, Beijing (CN); PoJing Liu, Beijing (CN)

( * ) Notice: Subject to any disclaimer, the term of this patent is extended or adjusted under 35 U.S.C. 154(b) by 0 days.

(21) Appl. No.: 16/033,693

(22) Filed: Jul. 12, 2018

(65) Prior Publication Data

US 2019/0016568 A1 Jan. 17, 2019

Related U.S. Application Data

(60) Provisional application No. 62/531,521, filed on Jul. 12, 2017.

(51) Int. Cl.

| | |
|---|---|
| ***B66C 5/02*** | (2006.01) |
| ***B66C 5/04*** | (2006.01) |
| ***E01D 21/06*** | (2006.01) |
| ***B66C 1/64*** | (2006.01) |
| ***B66C 17/20*** | (2006.01) |
| ***E01D 22/00*** | (2006.01) |
| ***B66C 19/00*** | (2006.01) |

(52) U.S. Cl.

CPC ..... *B66C 5/04* (2013.01); *B66C 1/64* (2013.01); *B66C 17/20* (2013.01); *B66C 19/00* (2013.01); *E01D 21/06* (2013.01); *E01D 22/00* (2013.01); *B66C 5/02* (2013.01)

(58) Field of Classification Search

CPC .. E01D 21/06; B66C 5/00; B66C 5/02; B66C 5/04; B66C 19/00

USPC ..... 14/77.1, 78

See application file for complete search history.

(56) References Cited

U.S. PATENT DOCUMENTS 3,246,775 A * 4/1966 Connelly ..... B65G 65/20 105/163.2

3,467,263 A * 9/1969 Yendrich, Jr. ..... B66C 11/02 212/307

(Continued)

FOREIGN PATENT DOCUMENTS

| | | |
|---|---|---|
| CN | 2234459 | 9/1996 |
| CN | 2617815 | 5/2004 |

(Continued)

*Primary Examiner* — Gary S Hartmann

(74) *Attorney, Agent, or Firm* — Nan Jiang; Dickinson Wright PLLC

(57) ABSTRACT

A gantry assembly includes a main beam extending between a first and a second end. A plurality of legs including a pair of first legs and a pair of second legs attached to the main beam. A pair of first trolleys is slidably attached to the main beam. A first girder is attached to each one of the first trolleys and extends outwardly from the first trolleys for movement with the first trolleys. The first girder includes a pair of posts having a first and a second post disposed spaced from one another. The first post is attached to the first girder and extends downwardly from the first girder. The second post is slidably attached to the first girder and is movable along the first girder toward and away from the main beam allowing the gantry assembly to have different widths to accommodate for a single or double railway bridge.

20 Claims, 12 Drawing Sheets

(56) References Cited

U.S. PATENT DOCUMENTS

| | | | | | |
|---|---|---|---|---|---|
| 3,571,835 | A * | 3/1971 | Buechler | E01D 21/00 | 14/77.1 |
| 3,579,759 | A * | 5/1971 | Zuccolo | E01D 21/00 | 249/209 |
| 4,630,798 | A * | 12/1986 | Muller | E01D 21/00 | 249/50 |
| 5,195,204 | A * | 3/1993 | Muller | E01D 21/105 | 14/4 |
| 5,511,268 | A * | 4/1996 | Albus | E01D 21/06 | 14/77.1 |
| 6,721,985 | B2 * | 4/2004 | McCrary | B60L 3/0046 | 14/77.1 |
| 8,671,490 | B1 * | 3/2014 | Carney | B66C 19/005 | 14/77.1 |
| 9,416,505 | B2 * | 8/2016 | Carney | B66C 19/005 | |
| 9,969,601 | B2 * | 5/2018 | Carney | B66C 19/005 | |
| 10,006,176 | B2 * | 6/2018 | Bermingham | E01D 21/06 | |
| 2014/0251936 | A1 * | 9/2014 | Carney | B66C 19/005 | 212/294 |

FOREIGN PATENT DOCUMENTS

| | | |
|---|---|---|
| CN | 1225589 | 11/2005 |
| CN | 2846480 | 12/2006 |
| CN | 200955124 | 10/2007 |
| CN | 201010862 | 1/2008 |
| CN | 201284462 | 8/2009 |

* cited by examiner

GANTRY ASSEMBLY AND A SYSTEM FOR REPLACING SINGLE OR DOUBLE RAILWAY BRIDGES

CROSS REFERENCE TO RELATED APPLICATION

This application claims the benefit of provisional application Ser. No. 62/531,521 filed on Jul. 12, 2017, the entire disclosure of which is incorporated herein by reference in its entirety.

BACKGROUND OF THE INVENTION

1. Field of the Invention

The present invention generally relates to a gantry assembly and a system for replacing at least one span of a single or a double railway bridge.

2. Description of the Prior Art

Steel bridges have been in use for nearly a century and some show significant signs of ageing and/or have corrosion. The ageing and corrosion will increase and eventually lead to a failure in the bridges structural integrity. Gantry assemblies are known in the prior art for replacing the span of the railway bridges. A problem with the gantry assemblies in the prior art is that they do not adjust to varying width of bridges to replace a plurality of parallel beams in the width of a bridge, and therefore, replacement of the aged and/or corroded beams requires the entire gantry to be repositioned to replace each beam in the width of a bridge.

One such a gantry assembly is disclosed in U.S. Pat. No. 9,163,367. The gantry assembly includes a main beam extending between a first end and a second end. A pair of first legs, spaced from one another, is attached to and extends downward from the main beam. A pair of second legs, spaced from one another and the first legs, is attached to and extends downward from the main beam. A pair of first trolleys is movably attached to the main beam for movement along the main beam between the first end and the second end.

SUMMARY OF THE INVENTION

The present invention provides an efficient solution for the removal and replacement of a single or double railway bridges. More specifically, the present invention allows for a more efficient use of space under the gantry assembly. In addition, the present invention provides for a gantry assembly that can accommodate bridges that has different widths and can be easily switched for use between single or double railway bridges. The present invention further provides a gantry assembly that can be easily transported to different locations.

It is one aspect of the present invention to provide a gantry assembly for replacing at least one span of a single or a double railway bridge. The gantry assembly includes a main beam extending between a first end and a second end. A plurality of legs includes a pair of first legs and a pair of second legs, spaced from one another, attached to the main beam for straddling the bridge. A pair of first trolleys slidably attached to the main beam for movement along the main beam between the first end and the second end. A first girder is attached to each one of the first trolleys and extends outwardly from said first trolleys for movement with the first trolleys along the main beam. The first girder includes a pair of posts having a first post and a second post. The first post and the second post are spaced from one another with the main beam being disposed between the posts. The first post is attached to the first girder and extends outwardly from the first girder, parallel to the legs, to a first distal end for engaging the bridge. The second post is slidably attached to the first girder and extends outwardly from the first girder, parallel to the first post, to a second distal end. The second post is movable along the first girder toward and away from the main beam allowing the gantry assembly to have different widths to accommodate for the single or the double railway bridge.

It is another aspect of the present invention to provide a system for replacing at least one span of a single or a double railway bridge. The system includes a gantry assembly and a plurality of transporters. The gantry assembly includes a main beam extending between a first end and a second end. A plurality of legs includes a pair of first legs and a pair of second legs, spaced from one another, attached to the main beam for straddling the bridge. A pair of first trolleys slidably attached to the main beam for movement along the main beam between the first end and the second end. A first girder is attached to each one of the first trolleys and extends outwardly from said first trolleys for movement with the first trolleys along the main beam. The first girder includes a pair of posts having a first post and a second post. The first post and the second post are spaced from one another with the main beam being disposed between the posts. The first post is attached to the first girder and extends outwardly from the first girder, parallel to the legs, to a first distal end for engaging the bridge. The second post is slidably attached to the first girder and extends outwardly from the first girder, parallel to the first post, to a second distal end. The second post is movable along the first girder toward and away from the main beam allowing the gantry assembly to have different widths to accommodate for the single or the double railway bridge. The plurality of transporters is disposed adjacent to each one of the first legs and the second legs of the gantry assembly. The transporter includes at least one idle transporter and at least one driven transporters releasably attached to the at least one idle transporter for moving the gantry assembly and the span of the bridge.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF THE ENABLING EMBODIMENT

Referring to the Figures, wherein like numerals indicate corresponding parts throughout the several views, it is one aspect of the present invention to provide a gantry assembly 20 for replacing at least one span of a single or a double railway bridge.

Figure 1:
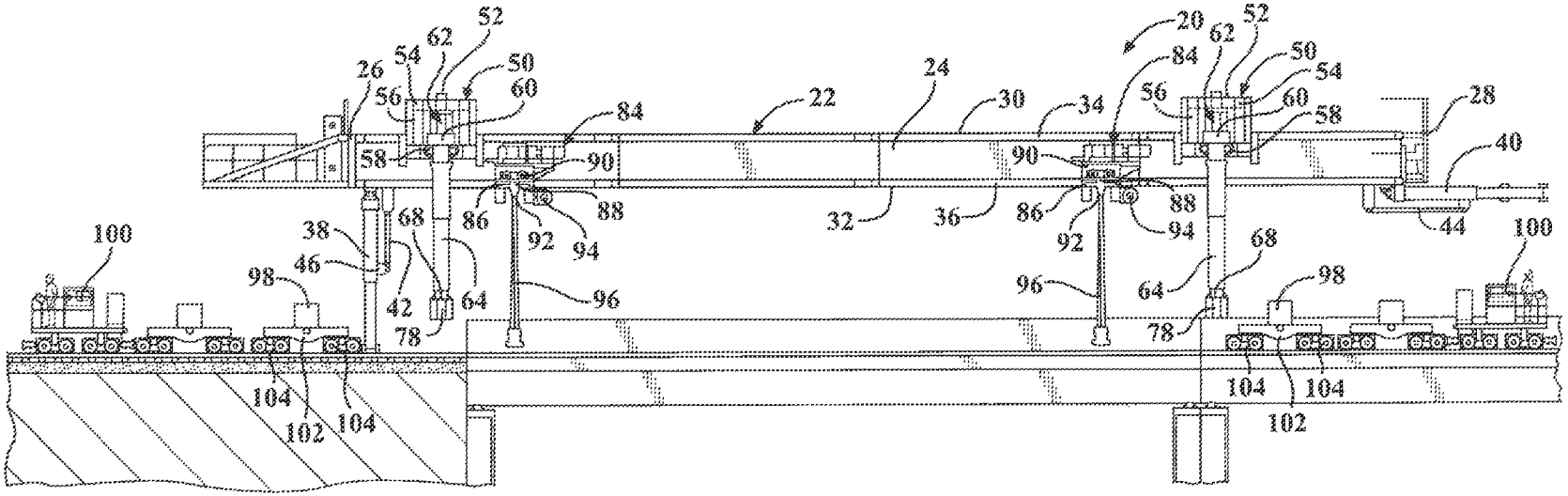
FIG. 1 is a side perspective view of the system including a gantry assembly and a plurality of transporters for replacing at least one span of a single or a double railway bridge.
Figure 2:
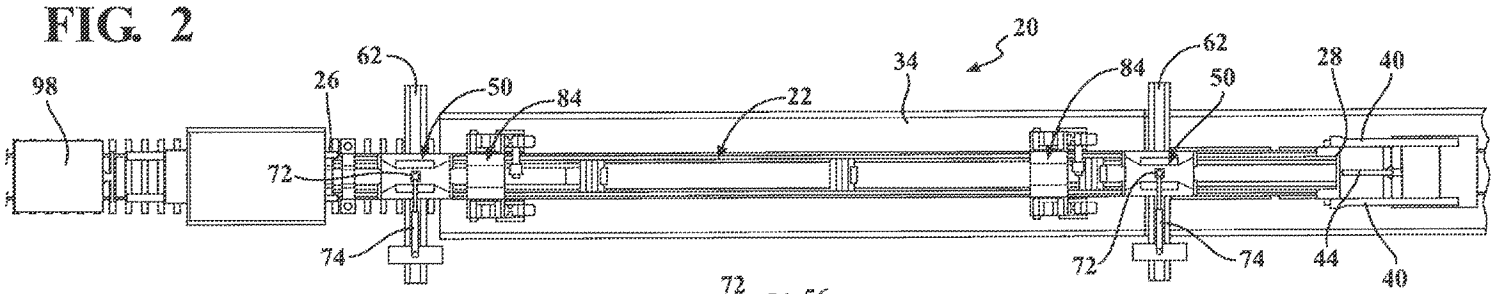
FIG. 2 is a top view of the gantry assembly.

The gantry assembly 20, as generally shown in FIGS. 1 and 2, includes a main beam 22 having an I-shaped cross-section. The main beam 22 includes a web 24 extending between a first end 26 and a second end 28 and has a top 30 and a bottom 32. The main beam 22 also includes a plurality of rails 34, 36 including a pair of first rails 34 and a pair of second rails 36. The pair of first rails 34 is disposed at the top 30 of the web 24 and extends perpendicularly outwardly from the web 24 and away from one another. The pair of second rails 36 is disposed at the bottom 32 of the web 24 and extends perpendicularly outwardly from the web 24 and parallel to the first rails 34, away from one another, to define the I-shaped cross-section. It should be appreciated that the main beam 22 can have a cross-section of any shape.

A plurality of legs 38, 40 including a pair of first legs 38 and a pair of second legs 40 are attached to the main beam 22 at the bottom 32 of the main beam 22 for straddling the bridge. The pair of first legs 38, spaced from one another, is pivotably attached to the main beam 22 at the first end 26 of the main beam 22. The pair of second legs 40, spaced from one another, is pivotably attached to the main beam 22 at the second end 28 of the main beam 22. The first legs 38 and the second legs 40 are pivotable between a first position and a second position. In the first position, the first legs 38 and the second legs 40 are perpendicular to the main beam 22 to provide support to the main beam 22. In the second position, the first legs 38 and the second legs 40 are disposed parallel to the main beam 22 thereby freeing up additional space underneath the main beam 22 and allowing the gantry assembly 20 to move the span of the bridge between the first end 26 and the second end 28 of the main beam 22. It should be appreciated that the first legs 38 and the second legs 40 can be telescopic relative to one another to allow a user to change the height of the gantry assembly 20 and to facilitate with the removal of the span of the bridge.

A plurality of arms 42, 44 includes at least one first arm 42 and at least one second arm 44 for moving the first legs 38 and the second legs 40 between the first position and the second position. The at least one first arm 42 is pivotably attached to the main beam 22 and extends parallel to the first legs 38 and attached to the first legs 38 via a first connecting member 46 for moving the pair of the first legs 38 together between the first position and the second position. Similarly, the at least one second arm 44 is pivotably attached to the main beam 22 and extends parallel to the second legs 40 and attached to the second legs 40 via a second connecting member for moving the pair of the second legs 40 between the first position and the second position. It should be appreciated that the first leg 38 and the second leg 40 can have similar structures. In addition, it should be appreciated that the at least one first arm 42 and the at least one second arm 44 can have similar structures.

Figure 3:
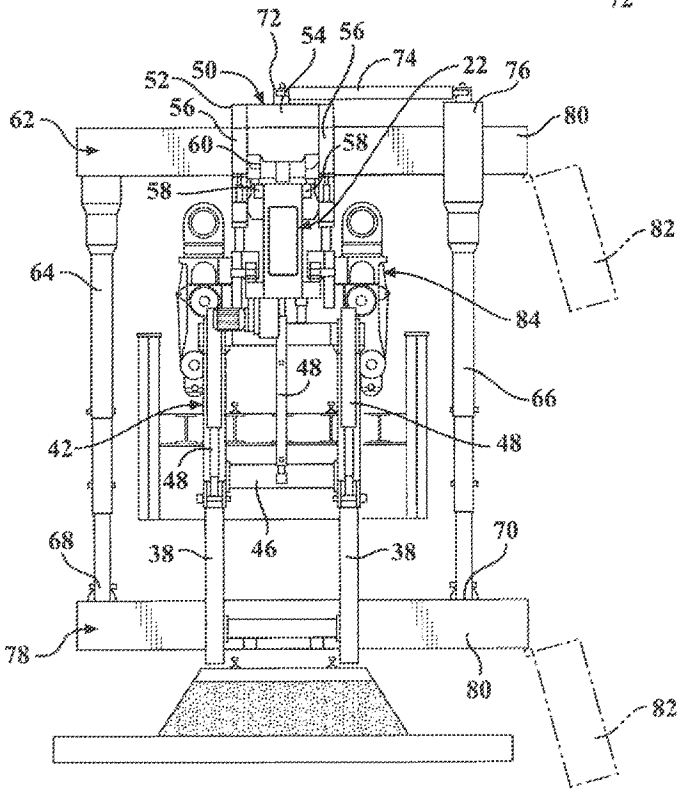
FIG. 3 is a front view of the gantry assembly with the second sections of the first girder and the second girder being in the storage position.
Figure 4:
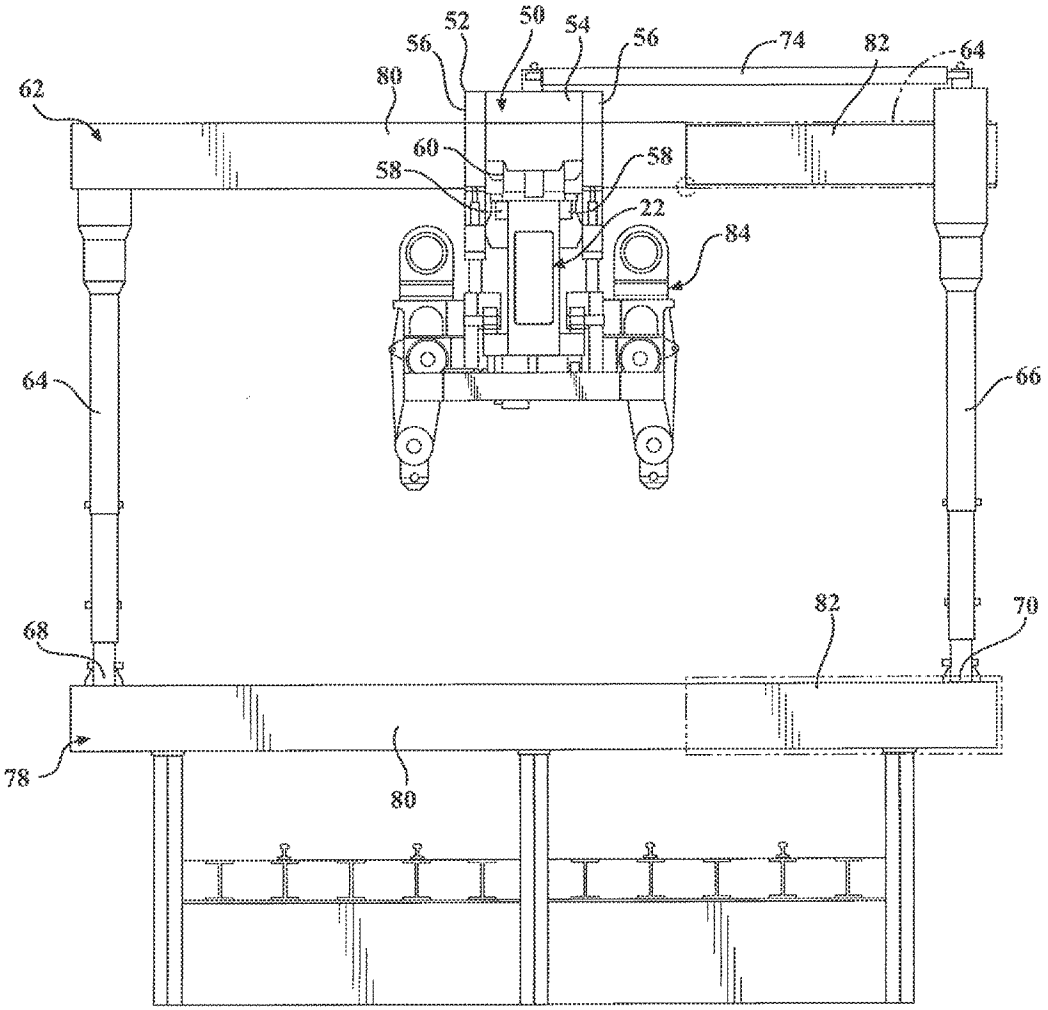
FIG. 4 is a front view of the gantry assembly with the second sections of the first girder and the second girder being in the extended position.

As best illustrated in FIG. 3, the at least one first arm 42 includes a plurality of three telescopic cylinders with one of the cylinders being attached to each one of the first legs 38. A third telescopic cylinder is disposed between first legs 38 and is connected to the first legs 48 via a connecting member 50 for moving the first legs 38 between the first position and the second position. When the third telescopic cylinder extends or retracts, the third telescopic cylinder drives the other two telescopic cylinders to rotate with respective to the connection points of the other two telescopic cylinders. It should be appreciated that the other two telescopic cylinders can pivot with the first legs 38 between the first position and the second position. It should be appreciated that the at least one second arm 44 can also include a plurality of three telescopic cylinders attached to the second legs 40 in a similar manner.

A pair of first trolleys 50 slidably attached to the first rails 34 of the main beam 22 for movement along the first rails 34 between the first end 26 and the second end 28 of the main beam 22. Each one of the first trolleys 50 includes a frame 52, having a generally inverted U-shaped cross-section, disposed about the first rails 34 of the main beam 22. The frame 52 includes an upper portion 54, spaced from and in a parallel relationship, with the first rails 34. A pair of side portions 56, spaced from one another, extends outwardly from the upper portion 54 toward the second rails 36 sandwiching the first rails 34 between the side portions 56. At least one inner wheel 58 is disposed adjacent to the web 24 and rotatably attached to the side portions 56 of the frame 50 and engaging the first rails 34 for moving the first trolleys 50 along the first rails 34 between the first end 26 of the second end 28 of the main beam 22. It should be appreciated that the first trolleys 50 can be moved along the first rails 34 of the main beam 22 using a rack or chain.

Each one of the first trolleys 50 includes a base 60, having a generally rectangular shape, disposed adjacent to the top 30 of the main beam 22 and attached to the side portions 56 of the frame 52 for movement with the first trolleys 50. A first girder 62 is attached to the base 60 and extends perpendicularly outwardly from the base 60 perpendicular and parallel to the first rails 34 for movement with the first trolleys 50 between the first end 26 and the second end 28 of the main beam 22. The first girder 62 includes a pair of posts 64, 66 having a first post 64 and a second post 66, spaced from one another, connected to the first girder 62 with the main beam 22 being disposed between the first post 64 and the second post 66. The first post 64 is attached to the first girder 62, extending perpendicularly outwardly from the first girder 62 and parallel to the legs 38, 40, to a first distal end 68 for engaging the bridge. The second post 66 is slidably attached to the first girder 62 and extends perpendicularly outwardly from the first girder 62, parallel to the first post 64, to a second distal end 70. The second post 66 is movable along the first girder 62 toward and away from the main beam 22 allowing the gantry assembly 20 to have different widths to accommodate for the single or the double railway bridge. In other words, the distance between the first post 64 and the second post 66 are adjustable to allow the gantry assembly 20 to have various widths to accommodate for different type of bridges, e.g. a single or a double railway bridge. It should be appreciated that the first post 64 and the second post 66 can be telescopic relative to one another to allow a user to change the height of the gantry assembly 20 and facilitate with the removal of the span of the bridge.

An actuator 72 is attached to the first girder 62 and coupled to the second post 66 for moving the second post 66 along the first girder 52 toward or away from the main beam 22. The actuator 72 includes an extension member 74, attached to the actuator 72 and extends outwardly from the actuator 72 parallel to the first girder 62 and attached to the second post 66 for transferring movement of the actuator 72 to the second post 66 to move the second post 66 along the first girder 62. It should be appreciated that the extension member 74 can be a transverse cylinder that is connected to actuator 72 and the second post 66 wherein the extension member 74 is able to extend and retract to move the second post 66 along the first girder 62. It should be appreciated that the actuator 72 can include sliding member 76 disposed between the second post 66 and the first girder 62 to facilitate with the movement of the second post 66 along the first girder 62.

A second girder 78 extends between the first post 64 and the second post 66 and is attached to the first distal end 68 of the first post 64 and the second distal end 70 of the second post 66 for engaging the bridge. The first girder 62 and the second girder 78 can each include a first section 80 and a second section 82. The second section 82 is movably attached to the first section 80. The second post 66 is attached to the second section 82 to allow the actuator 72 to move the second post 66 along the first girder 62. It should be appreciated that the first section 80 and the second section 82 can be disposed in a telescopic relationship with one another. Alternatively, as illustrated in phantom lines in FIG. 3, the first girder 62 and the second girder 78 can each include a first section 80 and a second section 82 wherein the second section 82 is pivotably attached to the first section 80. The second section 82 is movable between a storage position and an extended position. While in the storage position, the second section 82 is generally perpendicular to the first section 80. In the extended position, the second section 82 is coplanar with the first section 80 and connected to the first section 80 to allow the second post 66 to move along the second section 82 of the first girder 62 and the second girder 78 to increase the width of the gantry assembly 20. It should be appreciated that the first girder 62 and the second girder 78 can include a driving member attached to the first section 80 and the second section 82 for moving the second section 82 relative to the first section between the storage position and the extended position.

A pair of second trolleys 84, also known as lifting trolleys, is slidably attached to the second rails 36 for movement along the second rails 36 between the first end 26 and the second end 28 of the main beam 22. Each one of the second trolleys 84 includes a plate 86, having a generally rectangular shape, disposed adjacent to the bottom 32 of the web 24 and a pair of fins 88, spaced from one another, extending perpendicularly outwardly from the plate 86, toward the first rails 34 with the main beam 22 being disposed between the fins 88. At least one interior wheel 90 is disposed adjacent to the web 24 engaging the second rails 36 and rotatably attached to the fins 88 sandwiching the second rails 36 between the plate 86 and the interior wheel 90 for moving the second trolleys 84 along the second rails 36. A lifting spreader 92 is attached to the plate 86 spaced from the bottom 32 of the web 24. It should be appreciated that the interior wheels 90 can be disposed inside the lifting spreader 92. A winch 94 is attached to the lifting spreader 92. The winch 94 includes a cable 96 connected to the winch 94 and extends downwardly from the winch 94 for engaging the span of the bridge and extending and retracting the cable 96 to raise and lower the span of the bridge. The winch 94 can include a plurality of sensors including a first sensor and a second sensor. The first sensor is a lifting limit sensor for controlling the vertical position of the cable 96 and the lifted load, e.g. the span. The second sensor is an overweight sensor to ensure that the lifted load, e.g. the span, does not exceed an upper limit. It should be appreciated that the second trolleys can be moved along the first rail of the main beam using a rack or chain.

It is another aspect of the present invention to provide a system for replacing at least one span of a single or a double railway bridge. The system, as illustrated in FIGS. 1 and 5-13, includes a gantry assembly and a plurality of transporters.

The gantry assembly 20 includes a main beam 22 having an I-shaped cross-section. The main beam 22 includes a web 24 extending between a first end 26 and a second end 28 and has a top 30 and a bottom 32. The main beam 22 also includes a plurality of rails 34, 36 including a pair of first rails 34 and a pair of second rails 36. The pair of first rails 34 is disposed at the top 30 of the web 24 and extends perpendicularly outwardly from the web 24 and away from one another. The pair of second rails 36 is disposed at the bottom 32 of the web 24 and extends perpendicularly outwardly from the web 24 and parallel to the first rails 34, away from one another, to define the I-shaped cross-section. It should be appreciated that the main beam 22 can have a cross-section of any shape.

A plurality of legs 38, 40 including a pair of first legs 38 and a pair of second legs 40 are attached to the main beam 22 at the bottom 32 of the main beam 22 for straddling the bridge. The pair of first legs 38, spaced from one another, is pivotably attached to the main beam 22 at the first end 26 of the main beam 22. The pair of second legs 40, spaced from one another, is pivotably attached to the main beam 22 at the second end 28 of the main beam 22. The first legs 38 and the second legs 40 are pivotable between a first position and a second position. In the first position, the first legs 38 and the second legs 40 are perpendicular to the main beam 22 to provide support to the main beam 22. In the second position, the first legs 38 and the second legs 40 are disposed parallel to the main beam 22 thereby freeing up additional space underneath the main beam 22 and allowing the gantry assembly 20 to move the span of the bridge between the first end 26 and the second end 28 of the main beam 22. It should be appreciated that the first legs 38 and the second legs 40 can be telescopic relative to one another to allow a user to change the height of the gantry assembly 20 and to facilitate with the removal of the span of the bridge.

A plurality of arms 42, 44 includes at least one first arm 42 and at least one second arm 44 for moving the first legs 38 and the second legs 40 between the first position and the second position. The at least one first arm 42 is pivotably attached to the main beam 22 and extends parallel to the first legs 38 and attached to the first legs 38 via a first connecting member 46 for moving the pair of the first legs 38 together between the first position and the second position. Similarly, the at least one second arm 44 is pivotably attached to the main beam 22 and extends parallel to the second legs 40 and attached to the second legs 40 via a second connecting member for moving the pair of the second legs 40 between the first position and the second position. It should be appreciated that the first leg 38 and the second leg 40 can have similar structures. In addition, it should be appreciated that the at least one first arm 42 and the at least one second arm 44 can have similar structures.

The at least one first arm 42 includes a plurality of three telescopic cylinders with one of the cylinders being attached to each one of the first legs 38. A third telescopic cylinder is disposed between first legs 38 and is connected to the first legs 48 via a connecting member 50 for moving the first legs 38 between the first position and the second position. When the third telescopic cylinder extends or retracts, the third telescopic cylinder drives the other two telescopic cylinders to rotate with respective to the connection points of the other two telescopic cylinders. It should be appreciated that the other two telescopic cylinders can pivot with the first legs 38 between the first position and the second position. It should be appreciated that the at least one second arm 44 can also include a plurality of three telescopic cylinders attached to the second legs 40 in a similar manner.

A pair of first trolleys 50 slidably attached to the first rails 34 of the main beam 22 for movement along the first rails 34 between the first end 26 and the second end 28 of the main beam 22. Each one of the first trolleys 50 includes a frame 52, having a generally inverted U-shaped cross-section, disposed about the first rails 34 of the main beam 22. The frame 52 includes an upper portion 54, spaced from and in a parallel relationship, with the first rails 34. A pair of side portions 56, spaced from one another, extends outwardly from the upper portion 54 toward the second rails 36 sandwiching the first rails 34 between the side portions 56. At least one inner wheel 58 is disposed adjacent to the web 24 and rotatably attached to the side portions 56 of the frame 50 and engaging the first rails 34 for moving the first trolleys 50 along the first rails 34 between the first end 26 of the second end 28 of the main beam 22. It should be appreciated that the first trolleys 50 can be moved along the first rails 34 of the main beam 22 using a rack or chain.

Each one of the first trolleys 50 includes a base 60, having a generally rectangular shape, disposed adjacent to the top 30 of the main beam 22 and attached to the side portions 56 of the frame 52 for movement with the first trolleys 50. A first girder 62 is attached to the base 60 and extends perpendicularly outwardly from the base 60 perpendicular and parallel to the first rails 34 for movement with the first trolleys 50 between the first end 26 and the second end 28 of the main beam 22. The first girder 62 includes a pair of posts 64, 66 having a first post 64 and a second post 66, spaced from one another, connected to the first girder 62 with the main beam 22 being disposed between the first post 64 and the second post 66. The first post 64 is attached to the first girder 62, extending perpendicularly outwardly from the first girder 62 and parallel to the legs 38, 40, to a first distal end 68 for engaging the bridge. The second post 66 is slidably attached to the first girder 62 and extends perpendicularly outwardly from the first girder 62, parallel to the first post 64, to a second distal end 70. The second post 66 is movable along the first girder 62 toward and away from the main beam 22 allowing the gantry assembly 20 to have different widths to accommodate for the single or the double railway bridge. In other words, the distance between the first post 64 and the second post 66 are adjustable to allow the gantry assembly 20 to have various widths to accommodate for different type of bridges, e.g. a single or a double railway bridge. It should be appreciated that the first post 64 and the second post 66 can be telescopic relative to one another to allow a user to change the height of the gantry assembly 20 and facilitate with the removal of the span of the bridge.

An actuator 72 is attached to the first girder 62 and coupled to the second post 66 for moving the second post 66 along the first girder 52 toward or away from the main beam 22. The actuator 72 includes an extension member 74, attached to the actuator 72 and extends outwardly from the actuator 72 parallel to the first girder 62 and attached to the second post 66 for transferring movement of the actuator 72 to the second post 66 to move the second post 66 along the first girder 62. It should be appreciated that the extension member 74 can be a transverse cylinder that is connected to actuator 72 and the second post 66 wherein the extension member 74 is able to extend and retract to move the second post 66 along the first girder 62. It should be appreciated that the actuator 72 can include sliding member 76 disposed between the second post 66 and the first girder 62 to facilitate with the movement of the second post 66 along the first girder 62.

A second girder 78 extends between the first post 64 and the second post 66 and is attached to the first distal end 68 of the first post 64 and the second distal end 70 of the second post 66 for engaging the bridge. The first girder 62 and the second girder 78 can each include a first section 80 and a second section 82. The second section 82 is movably attached to the first section 80. The second post 66 is attached to the second section 82 to allow the actuator 72 to move the second post 66 along the first girder 62. It should be appreciated that the first section 80 and the second section 82 can be disposed in a telescopic relationship with one another. Alternatively, The first girder 62 and the second girder 78 can each include a first section 80 and a second section 82 wherein the second section 82 is pivotably attached to the first section 80. The second section 82 is movable between a storage position and an extended position. While in the storage position, the second section 82 is generally perpendicular to the first section 80. In the extended position, the second section 82 is coplanar with the first section 80 and connected to the first section 80 to allow the second post 66 to move along the second section 82 of the first girder 62 and the second girder 78 to increase the width of the gantry assembly 20. It should be appreciated that the first girder 62 and the second girder 78 can include a driving member attached to the first section 80 and the second section 82 for moving the second section 82 relative to the first section between the storage position and the extended position.

A pair of second trolleys 84, also known as lifting trolleys, is slidably attached to the second rails 36 for movement along the second rails 36 between the first end 26 and the second end 28 of the main beam 22. Each one of the second trolleys 84 includes a plate 86, having a generally rectangular shape, disposed adjacent to the bottom 32 of the web 24 and a pair of fins 88, spaced from one another, extending perpendicularly outwardly from the plate 86, toward the first rails 34 with the main beam 22 being disposed between the fins 88. At least one interior wheel 90 is disposed adjacent to the web 24 engaging the second rails 36 and rotatably attached to the fins 88 sandwiching the second rails 36 between the plate 86 and the interior wheel 90 for moving the second trolleys 84 along the second rails 36. A lifting spreader 92 is attached to the plate 86 spaced from the bottom 32 of the web 24. It should be appreciated that the interior wheels 90 can be disposed inside the lifting spreader 92. A winch 94 is attached to the lifting spreader 92. The winch 94 includes a cable 96 connected to the winch 94 and extends downwardly from the winch 94 for engaging the span of the bridge and extending and retracting the cable 96 to raise and lower the span of the bridge. The winch 94 can include a plurality of sensors including a first sensor and a second sensor. The first sensor is a lifting limit sensor for controlling the vertical position of the cable 96 and the lifted load, e.g. the span. The second sensor is an overweight sensor to ensure that the lifted load, e.g. the span, does not exceed an upper limit. It should be appreciated that the second trolleys can be moved along the first rail of the main beam using a rack or chain.

The plurality of transporters 98, 100 includes at least one idle transporter 98 and at least one drive transporter 100. The transporters 98, 100 are disposed adjacent to the first legs 38 and the second legs 40 of the gantry assembly 20. The at least one driven transporters 100 can be attached to the at least one idle transporter 98 for moving the gantry assembly 20 and the span of the bridge. The at least one idle transporter 98 includes a platform 102 for receiving the legs 38, 40 of the gantry assembly 20 or the span of the bridge. A plurality of tires 104 is rotatably attached to the platform 102 for moving the platform 102. When loaded with the span of the bridge, the at least one idle transporter 98 can be fixed with the span whereby the span of the bridge can be used to connect the at least one idle transporter 98 with the at least one driven transporter 100. The at least one driven transporter 100 can be attached to the at least one idle transporter 98 for moving the at least one idle transporter 98 to transport the span of the bridge or the gantry assembly 20.

Figure 5:
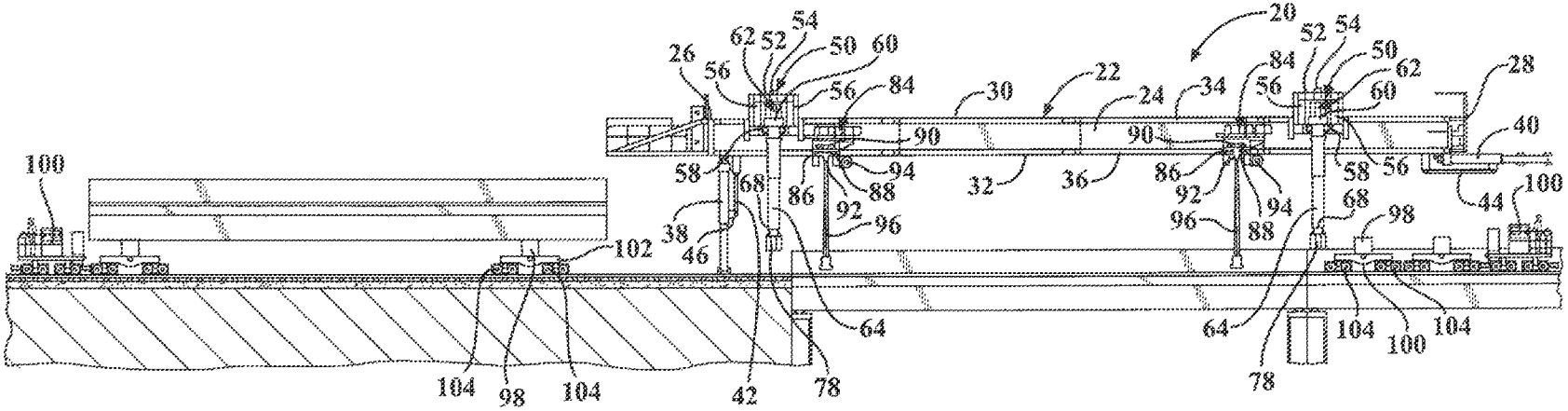
FIGS. 5 through 8 are side views of the system showing the gantry assembly and the transporters at different stages as a span is being removed from a bridge.

The operation of the gantry assembly 20 and the transporters 98, 100 are illustrated in FIGS. 5-13. As best illustrated in FIG. 5, the gantry assembly 20 is first moved by the transporters 98, 100 to a bridge span replacement position. The first legs 38 and the second legs 40 are deployed in the first position to engage the ground or the deck, the height of the gantry assembly 20 can be appropriately adjusted using the legs 38, 40. One of the first trolleys 50 including the first post 64 and the second post 66 is moved along the main beam 22 to a position such that the second girder 78 is adjacent to the edge of the span to be removed. The first post 64 and the second post 66 are deployed to engage the bridge. At this time, the second legs 40 are released from the ground or the deck and moved from the first position to the second position. The second trolleys 84, also known as the lifting trolleys, are prepared for attachment to a cut span while the transporters 98, 100 carry a new span to the side of the cut span.

Figure 6:
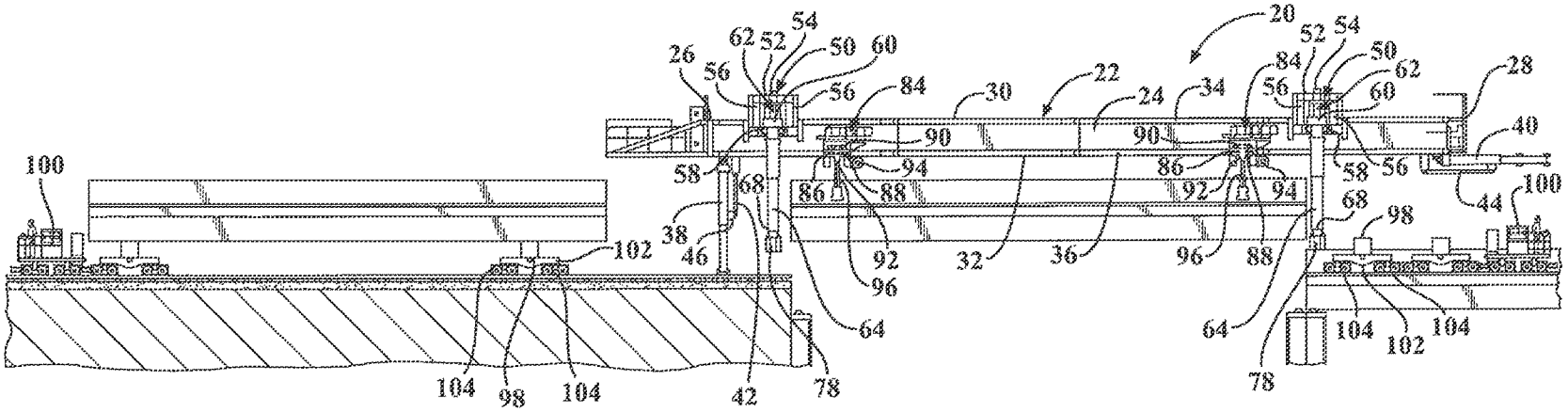
Figure 7:
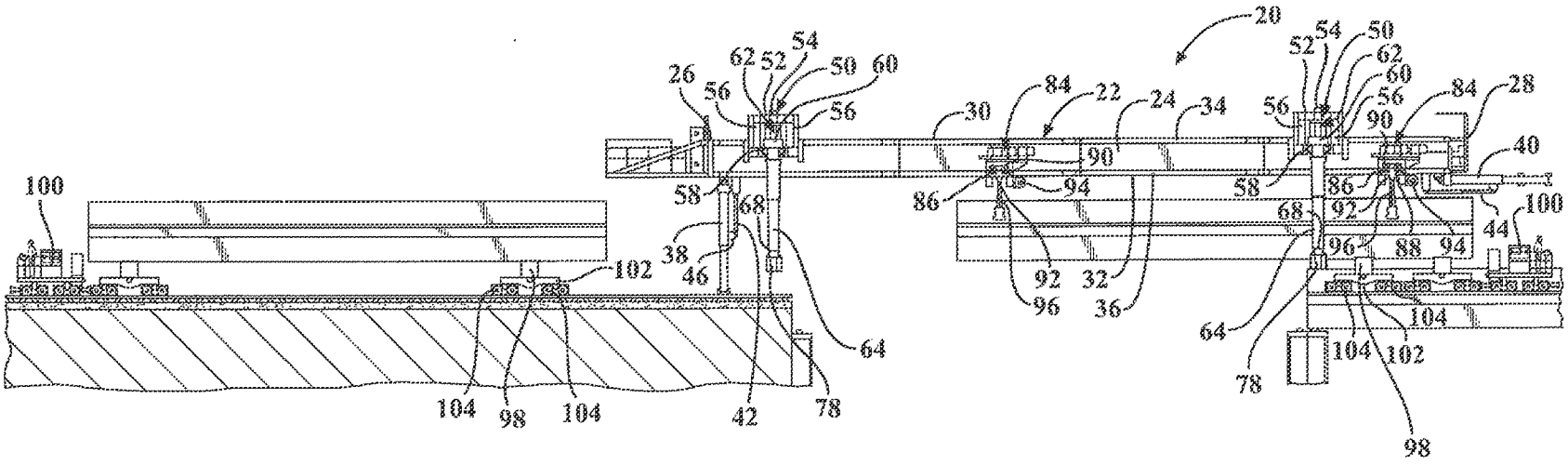
Figure 8:
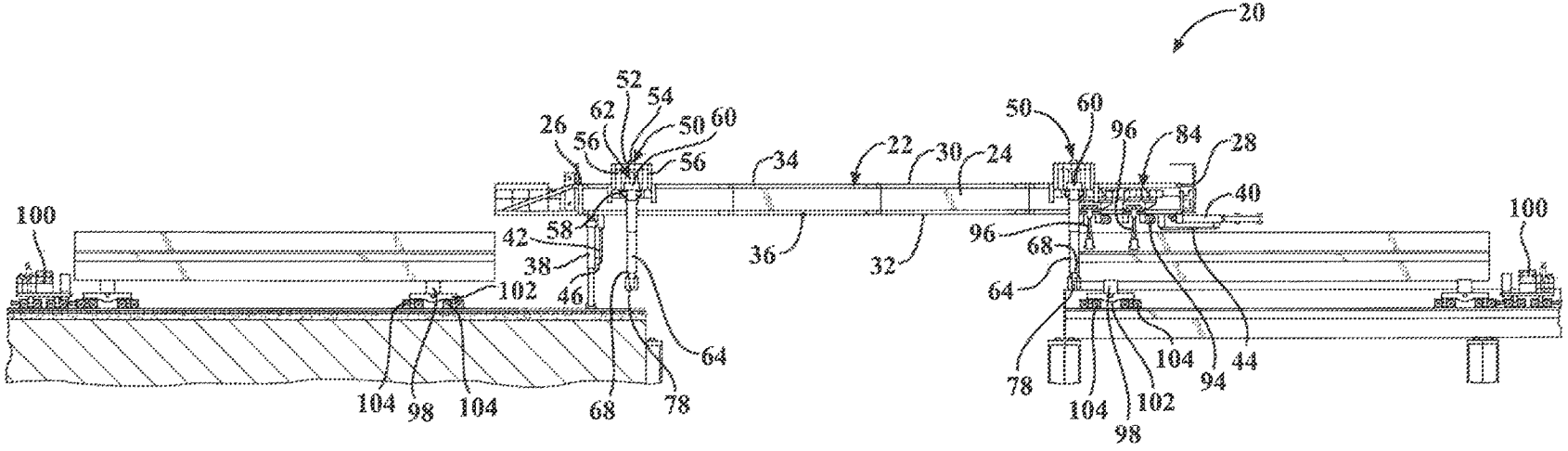

As best shown in FIG. 6, after cutting the span, the second trolleys 84 are moved along the main beam 22 to be directly over the cut span. The cables 96 of the second trolleys 84 are then lowered and attached to the cut span for lifting the cut span. Next, as best shown in FIGS. 7 and 8, the cut span is lifted by the second trolleys 84 to a height that is greater than the idle transporters 98. Then, the second trolleys 84 move the cut span toward the second legs 40 until the cut span is over the driven transporter 100. The cut span is lowered and fixed onto the driven transporter 100. In response to fixing the cut span to the driven transporter 100, one of the second trolleys 84 releases the cut span near the driven transporter 100. Then, the driven transporter 100 is moved along the main beam 22 until the rear end of the cut span is over the idle transporter 98. The rear end of the cut span is fixed to the idle transporter 98 and released from the other one of the second trolleys 84. The transporters 98, 100 move the cut span back to a yard for disposal.

Figure 9:
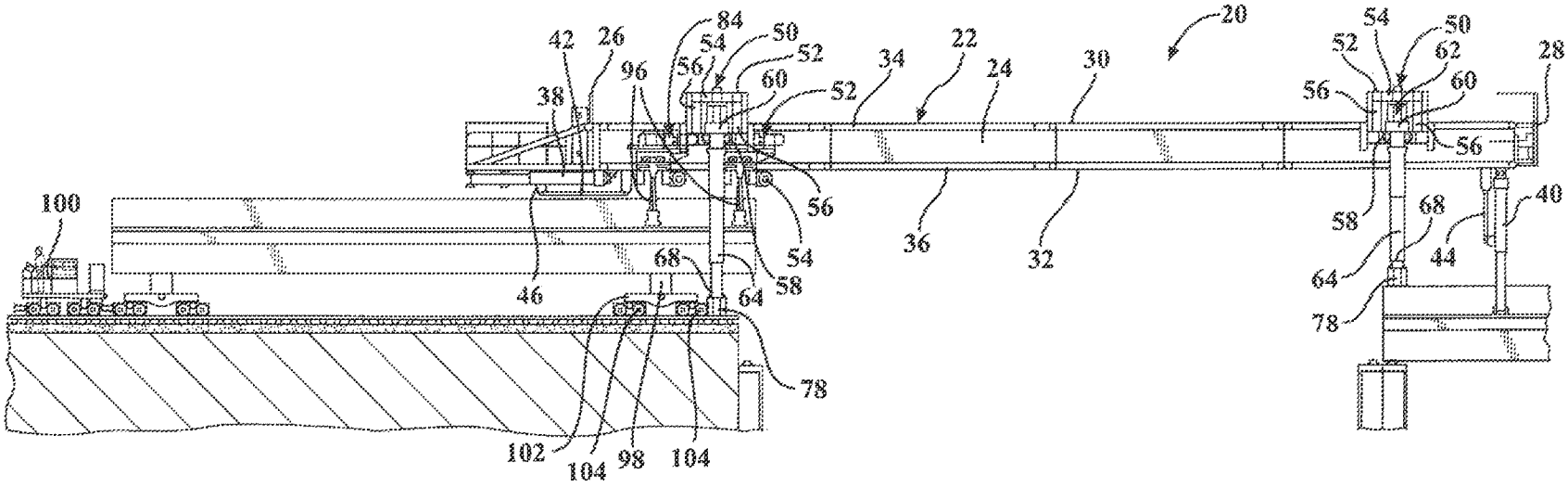
FIGS. 9 through 13 are side views of the system showing the gantry assembly and the transporters at different stages as a new span is being placed onto the bridge.
Figure 10:
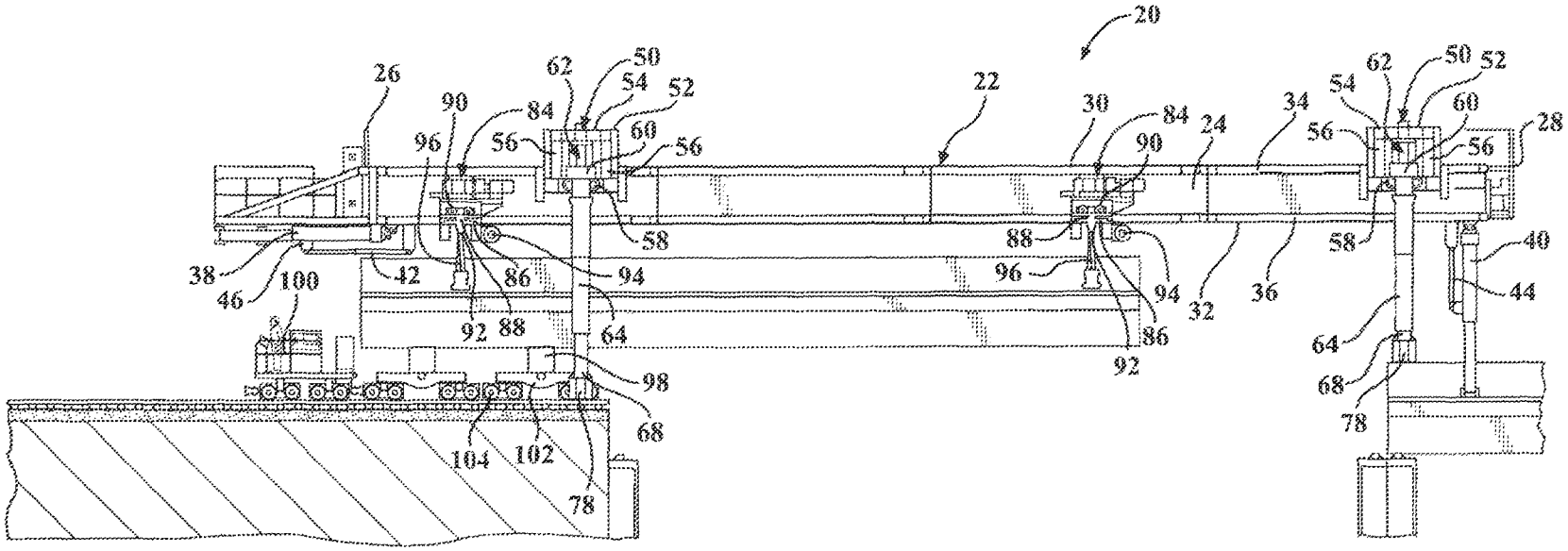

After transporting the cut span, as illustrated in FIG. 9, the second legs 40 are moved from the second position to the first position for supporting the main beam 22 of the gantry assembly 20 on the ground or the deck. The other one of the first trolleys 50 is moved over the ground. The first post 64 and the second post 66 are adjusted such that the second girder 78 engages the ground to support the main beam 22 of the gantry assembly 20. The first legs 38 are release from the ground or the deck and moved from the first position to the second position. As illustrated in FIGS. 9 and 10, the transporters 98, 100 including a new span attached to the driven transporter 100 and the idle transporter 98 move the new span under the main beam 22 adjacent to the first legs 38. The cable 96 of one the second trolleys 84 is lowered and attached to the new span at the front end. At this same time, the new span is released from the idle transporter 98. The second trolley 84 then moves the new span along the main beam 22 along with the driven transporter 100 with the new span being fixed to the driven transporter 100. Once the driven transporter 100 is in contact with the idle transporter 98, the cable 96 of the other one of the second trolleys 84 is lowered and attached to the rear end of the new span and, at the same time, the new span is released from the driven transporter 100.

Figure 11:
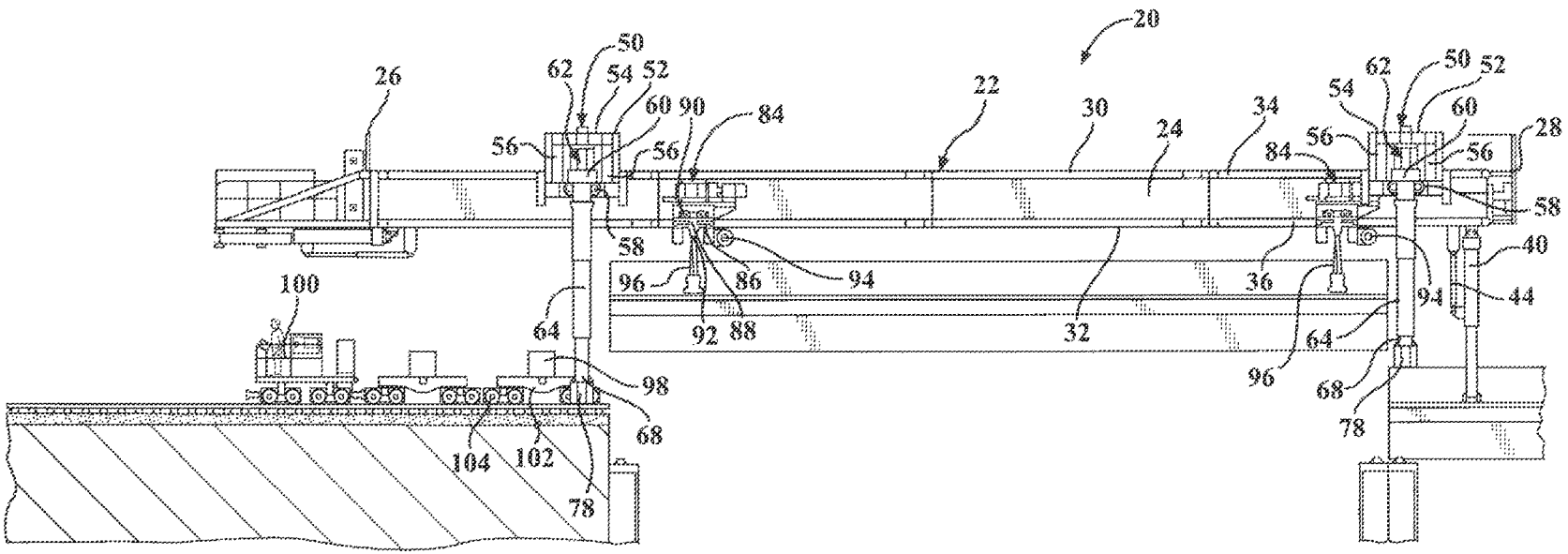
Figure 12:
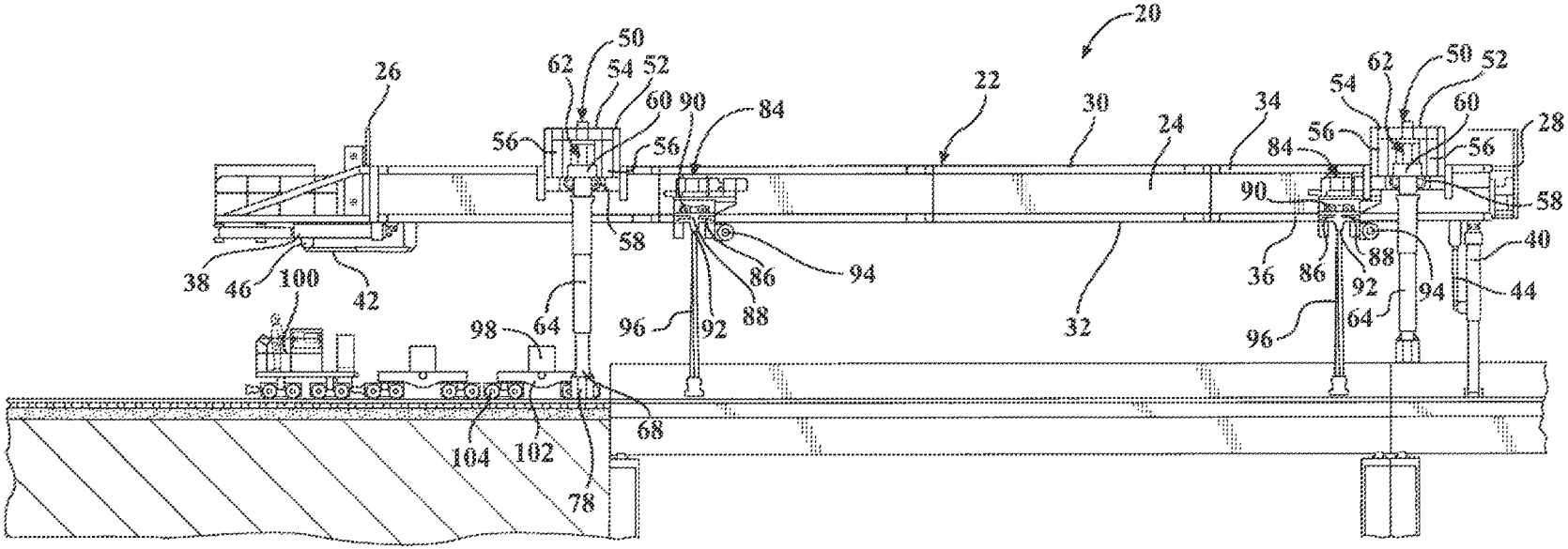
Figure 13:
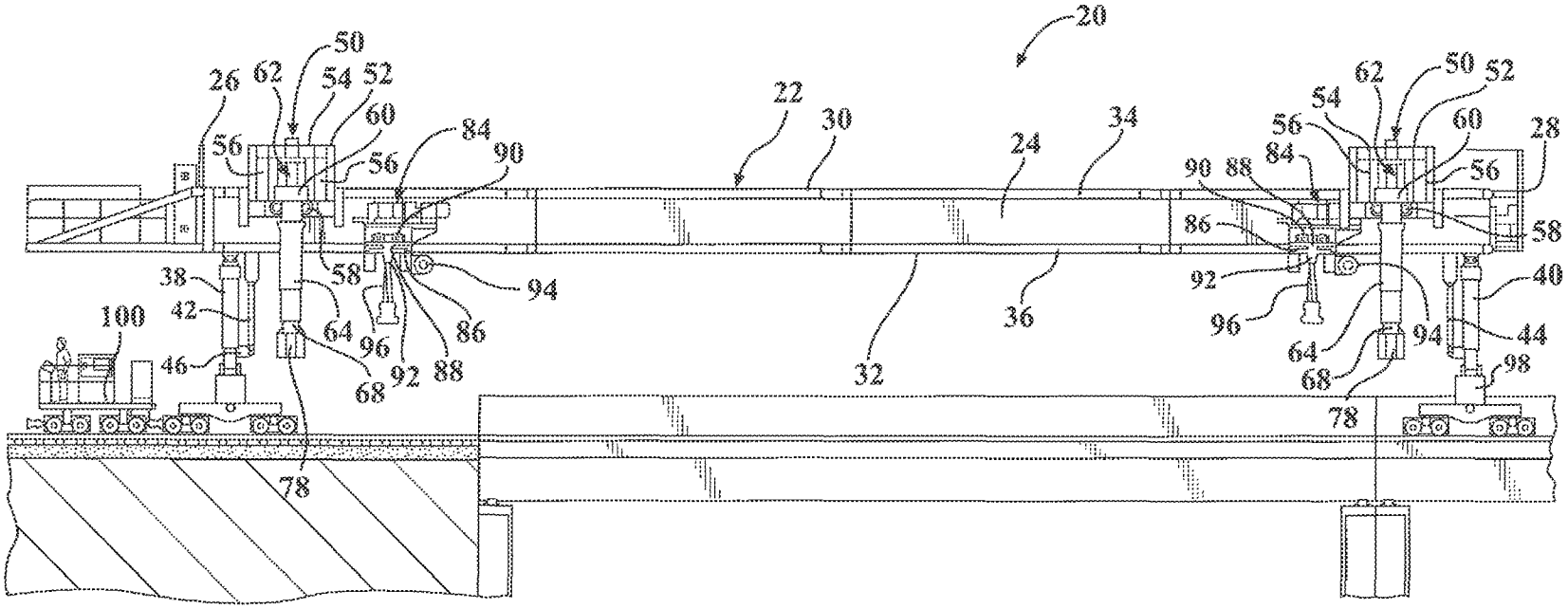

As illustrated in FIG. 11, the second trolleys 84 move the new span along the main beam 22 to a position where the cut span is removed. Then, as illustrated in FIG. 12, the new span is lowered onto the piers by second trolleys 84 whereby new rails are laid to complete the replacement of the span of the bridge. Next, as illustrated in FIG. 13, the transporters 98, 100 can be used to transport the gantry assembly 20. To transport the gantry assembly 20, the second legs 40 are first retracted to the height of the idle transporter 98 and are attached to the idle transporter 98. Then, the first legs 38 are retracted to the height of the driven transporter 100 and are attached to the driven transporter 100. The distance between the posts 64, 66 is adjusted to be equivalent to the spacing between the first legs 38. Then, the transporters 98, 100 can be used to move the gantry assembly 20 to a different location.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims.

What is claimed is:

1. A gantry assembly for replacing at least one span of a single or a double railway bridge, said gantry assembly comprising:

a main beam extending between a first end and a second end;

a plurality of legs including a pair of first legs and a pair of second legs disposed spaced from one another and attached to said main beam for straddling the bridge;

a pair of first trolleys slidably attached to said main beam for movement along said main beam between said first end and said second end;

a first girder attached to each one of said first trolleys and extending outwardly from said first trolleys for movement with said first trolleys along said main beam;

said first girder including a pair of posts including a first post and a second post spaced from one another with said main beam being disposed between said posts and said first post being attached to said first girder and extending outwardly from said first girder and parallel to said legs to a first distal end for engaging the bridge; and said second post being slidably attached to said first girder and extending outwardly from said first girder1 parallel to said first post to a second distal end with said second post being movable along said first girder toward and away from said main beam allowing said gantry assembly to have different widths to accommodate for the single or the double railway bridge.

2. The gantry assembly as set forth in claim 1 further including an actuator attached to said first girder and coupled to said second post for moving said at second post along said first girder.

3. The gantry assembly as set forth in claim 2 wherein said actuator includes an extension member attached to said actuator and extends outwardly from said actuator to said first girder and attached to said second post for transferring movement of said actuator to said second post to move said second post along said first girder.

4. The gantry assembly as set forth in claim 1 wherein said first legs and said second legs are pivotably attached to said main beam at said second end of said main beam with said first leg and said second leg being movable between a first position and a second position with said first position being defined as said first legs and said second legs being perpendicular to said main beam to provide support to said main beam and said second position being defined as said first legs and said second legs being parallel to said main beam.

5. The gantry assembly as set forth in claim 4 further including a plurality of arms including at least one first arm attached to said first legs and at least one second arm attached to said second legs for moving said first legs and said second legs between said first position and said second position.

6. The gantry assembly as set forth in claim 2 further including a second girder extending between the first post and the second post and attached to said first distal end and said second distal end for engaging the bridge.

7. The gantry assembly as set forth in claim 6 wherein said first girder and said second girder each include a first section and a second section with said second section being movably attached to said first section and said second post being attached to said second section to allow said actuator to move said second post along said first girder.

8. The gantry assembly as set forth in claim 7 wherein said first section and said second section are disposed in a telescopic relationship with one another.

9. The gantry assembly as set forth in claim 6 wherein said first girder and said second girder each include a first section and a second section with said second section being pivotably attached to said first section and movable between a storage position and an extended position with said storage position being defined as said second section being perpendicular to said first section and parallel to said second post and said extended position being defined as said second section being coplanar with said first section and perpendicular to said second post.

10. The gantry assembly as set forth in claim 9 further including a driving member disposed on said first girder and said second girder and attached to said first section and said second section for moving said second section between said storage position and said extended position.

11. A system for replacing at least one span of a single or a double railway bridge, said system comprising:

a gantry assembly including a main beam extending between a first end and a second end;

a plurality of legs including a pair of first legs and a pair of second legs disposed spaced from one another and attached to said main beam for straddling the bridge;

a pair of first trolleys slidably attached to said main beam for movement along said main beam between said first end and said second end;

a first girder attached to each one of said first trolleys and extending outwardly from said first trolleys for movement with said first trolleys along said main beam;

said first girder including a pair of posts including a first post and a second post spaced from one another with said main beam being disposed between said posts and said first post being attached to said first girder and extending outwardly from said first girder to a first distal end for engaging the bridge;

a plurality of transporters including at least one idle transporter disposed adjacent to each one of said first legs and said second legs of said gantry assembly and at least one driven transporters releasably attached to said at least one idle transporter for moving said gantry assembly and the span of the bridge; and said second post being slidably attached to said first girder and extending outwardly from said first girder parallel to said first post to a second distal end with said second post being movable along said first girder toward and away from said main beam allowing said gantry assembly to have different widths to accommodate for the single or the double railway bridge.

12. The system as set forth in claim 11 further including an actuator attached to said first girder and coupled to said second post for moving said at second post along said first girder.

13. The system as set forth in claim 12 wherein said actuator includes an extension arm attached to said actuator and extends outwardly from said actuator to said first girder and attached to said second post for transferring movement of said actuator to said second post to move said second post along said first girder.

14. The system as set forth in claim 11 wherein said first legs and said second legs are pivotably attached to said main beam at said second end of said main beam with said first leg and said second leg being movable between a first position and a second position with said first position being defined as said first legs and said second legs being perpendicular to said main beam to provide support to said main beam and said second position being defined as said first legs and said second legs being parallel to said main beam.

15. The gantry assembly as set forth in claim 14 further including a plurality of arms including at least one first arm attached to said first legs and at least one second arm attached to said second legs for moving said first legs and said second legs between said first position and said second position.

16. The gantry assembly as set forth in claim 12 further including a second girder extending between the first post and the second post and attached to said first distal end and said second distal end for engaging the bridge.

17. The gantry assembly as set forth in claim 16 wherein said first girder and said second girder each includes a first section and a second section with said second section being movably attached to said first section and said second post being attached to said second section to allow said actuator to move said second post along said first girder.

18. The gantry assembly as set forth in claim 17 wherein said first section and said second section are disposed in a telescopic relationship with one another.

19. The gantry assembly as set forth in claim 16 wherein said first girder and said second girder each includes a first section and a second section with said second section being pivotably attached to said first section and movable between a storage position and an extended position with said storage position being defined as said second section being perpendicular to said first section and parallel to said second post and said extended position being defined as said second section being coplanar with said first section and perpendicular to said second post.

20. A gantry assembly for replacing at least one span of a single or a double railway bridge, said gantry assembly comprising:

a main beam having an I-shaped cross-section including a web extending between a first end and a second end and having a top and a bottom;

a pair of first rails disposed at said top of said web and extending perpendicularly outwardly from said web and away from one another;

a pair of second rails disposed at said bottom of said web and extending perpendicularly outwardly from said web and parallel to said pair of first rails and away from one another to define said I-shaped cross-section;

a plurality of legs including a pair of first legs and a pair of second legs attached to said main beam for straddling the bridge;

said pair of first legs having telescoping segments and spaced from one another and pivotably attached to said main beam at said first end of said main beam and said pair of second legs having telescoping segments and spaced from one another;

a plurality of arms including at least one first arm attached to said first legs and at least one second arm attached to said second legs for moving said first legs and said second legs between said first position and said second position;

said at least one first arm being pivotably attached to said main beam and extending parallel to said first legs and attached to said first legs for moving said first legs between said first position and said second position;

said at least one second arm being pivotably attached to said main beam and extending parallel to said second legs and attached to said second legs for moving said second legs between said first position and said second position;

a pair of first trolleys slidably attached to said first rails of said main beam for movement along said first rails between said first end and said second end of said main beam;

each one of said first trolleys including a frame of generally U-shaped cross-section disposed about said first rails of said main beam;

said frame including an upper portion disposed spaced from and parallel to said first rails and a pair of side portions disposed spaced from one another and extending perpendicularly outwardly from said upper portion toward said second rails to sandwich said first rails between said side portions;

at least one inner wheel disposed adjacent to said web and rotatably attached to said side portions of said frame and engaging said first rails for moving said first trolleys along said first rails between said first end of said second end of said main beam;

each one of said first trolleys including a base of generally rectangular shape disposed adjacent to an upper surface of said first rails;

a first girder attached to said base and extending outwardly from said base perpendicular to said main beam and parallel to said first rails for movement with said first trolleys between said first end and said second end of said main beam;

said first girder including a pair of posts including a first post and a second post spaced from one another with said main beam being disposed between said posts and said first post being attached to said first girder and extending outwardly from said first girder to a first distal end for engaging the bridge;

a pair of second trolleys slidably attached to said second rails for movement along said second rails between said first end and said second end;

each one of said second trolleys including a plate of generally rectangular shape disposed adjacent to a bottom surface of said second rails and a pair of fins extending perpendicularly outwardly from said plate toward said second rails and spaced from one another with said main beam being disposed between said fins;

at least one interior wheel disposed at a top surface of said second rails and adjacent to said web and rotatably attached to said fins sandwiching said second rails between said plate and said wheel for moving said second trolleys along said second rails between said first end of said second end of said main beam;

each of said second trolleys including a lift spreader attached to said plate spaced from said bottom of said web;

a winch attached to said lifting spreader and including a cable extending downwardly from said winch for engaging the span of the bridge and extending and retracting said cable to raise and lower the span of the bridge;

said winch having a plurality of sensors including a first sensor and a second sensor with said first sensor being a lifting limit sensor for controlling the vertical position of said cable and said second sensor being an overweight sensor attached for ensuring the span does not exceed an upper limit; and said second post being slidably attached to said first girder and extending outwardly from said first girder parallel to said first post to a second distal end with said second post being movable along said first girder toward and away from said main beam allowing said gantry assembly to have different widths to accommodate for the single or the double railway bridge;

an actuator attached to said first girder and coupled to said second post for moving said at second post along said first girder;

said actuator including an extension member attached to said actuator and extending outwardly from said actuator parallel to said first girder and attached to said second post for transferring movement of said actuator to said second post to move said second post along said first girder;

said first leg and said second leg being pivotably attached to said main beam at said second end of said main beam with said first leg and said second leg being movable between a first position and a second position with said first position being defined as said first legs and said second legs being perpendicular to said main beam to provide support to said main beam and said second position being defined as said first legs and said second legs being parallel to said main beam;

a second girder extending between the first post and the second post and attached to said first distal end and said second distal end for engaging the bridge.

* * * * *